US009052644B2

(12) United States Patent
Yagi et al.

(10) Patent No.: US 9,052,644 B2
(45) Date of Patent: Jun. 9, 2015

(54) IMAGE FORMING APPARATUS

(71) Applicant: CANON KABUSHIKI KAISHA, Tokyo (JP)

(72) Inventors: Yasutaka Yagi, Mishima (JP); Taku Kanai, Yokohama (JP); Takaaki Tsuruya, Mishima (JP); Hiroyuki Seki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/107,228

(22) Filed: Dec. 16, 2013

(65) Prior Publication Data

US 2014/0178110 A1 Jun. 26, 2014

(30) Foreign Application Priority Data

Dec. 21, 2012 (JP) ..... 2012-280279

(51) Int. Cl.
*G03G 15/01* (2006.01)
*G03G 15/16* (2006.01)

(52) U.S. Cl.
CPC ..... *G03G 15/1605* (2013.01)

(58) Field of Classification Search
CPC ..... G03G 15/161; G03G 15/0189; G03G 2215/1661; G03G 15/0194; G03G 15/1615; G03G 21/12; G03G 15/6529; G03G 21/105; G03G 2221/1684; G03G 15/0131; G03G 2215/0132; G03G 15/0136; G03G 15/1605
USPC ..... 399/162, 239, 278, 288, 303, 312, 313, 399/329, 352, 176, 279, 357
See application file for complete search history.

(56) References Cited

U.S. PATENT DOCUMENTS

| | | | | |
|---|---|---|---|---|
| 6,430,379 | B1 | 8/2002 | Takahashi et al. | |
| 2003/0128999 | A1* | 7/2003 | Bessho et al. | 399/121 |
| 2009/0232530 | A1 | 9/2009 | Saito et al. | |
| 2011/0008070 | A1* | 1/2011 | Sato | 399/176 |
| 2012/0301191 | A1* | 11/2012 | Ito | 399/308 |

FOREIGN PATENT DOCUMENTS

| | | | |
|---|---|---|---|
| JP | 2000-206798 | A | 7/2000 |
| JP | 2001-188424 | A | 7/2001 |
| JP | 2009-75154 | A | 4/2009 |
| JP | 2009-205012 | A | 9/2009 |
| JP | 2012-159737 | A | 8/2012 |

* cited by examiner

*Primary Examiner* — Roy Y Yi
(74) *Attorney, Agent, or Firm* — Fitzpatrick, Cella, Harper & Scinto

(57) ABSTRACT

An image forming apparatus includes an image bearing member, an intermediate transfer member, and a secondary transfer member having a plurality of protrusions which come into contact with the intermediate transfer member. A superficial layer of the intermediate transfer member includes a superficial layer and a plurality of insulating particles buried in the superficial layer so as to be partially exposed from she superficial layer. In the case where the insulating particles are present in a contact region in which the protrusions are brought into contact with the intermediate transfer member, a portion in which the protrusions are brought into direct contact with the superficial layer is present in the contact region.

16 Claims, 7 Drawing Sheets

IMAGE FORMING APPARATUS

BACKGROUND OF THE INVENTION

1. Field of the Invention

The present invention relates to an image forming apparatus such as a copier, a printer, or a facsimile machine using an electrophotographic system or an electrostatic recording system.

2. Description or the Related Art

As a related-art of an image forming apparatus using an electrophotographic system, for example, there is given an image forming apparatus of an intermediate transfer system using an intermediate transfer member. In the image forming apparatus of an intermediate transfer system, a toner image formed on a photosensitive member is primarily transferred onto an intermediate transfer member, and thereafter, the toner image on the intermediate transfer member is secondarily transferred onto a transfer material. As the intermediate transfer member, an intermediate transfer belt which is an endless belt has been widely used.

Japanese Patent Application Laid-Open No. 2009-73154 proposes that the releasing property with respect to a superficial layer of an intermediate transfer belt be improved by burying particles having a diameter smaller than that, of toner particles in a surface of an adhesive layer (superficial layer) of the intermediate transfer belt to enhance transfer efficiency.

However, in the configuration described in Japanese Patent Application Laid-Open No. 2009-75154, the superficial, layer of the intermediate transfer belt and the particles buried therein have an insulation property without being adjusted for electric resistance, and more insulating particles ace exposed from the surface of the intermediate transfer belt. In the case where more insulating particles are exposed from the surface, image defects may occur when charging up the intermediate transfer belt, in particular, charging up the particles.

SUMMARY OF THE INVENTION

The present invention provides an image forming apparatus capable of preventing image defects which occur when an intermediate transfer member is charged up in a configuration in which particles are exposed from the surface of the intermediate transfer member.

It is another object of the present invention to provide an image forming apparatus; including: an image bearing member bearing a toner image; an intermediate transfer member transferring the toner image on the image bearing member onto a transfer material, the intermediate transfer member being movable and including a superficial layer in which a plurality of insulating particles are burred so as to be partially exposed from the superficial layer; and a secondary transfer member nipping the transfer material between the secondary transfer member and the intermediate transfer member and transferring the toner image on the intermediate transfer member onto the transfer material when supplied with a voltage, the secondary transfer member including a plurality of protrusions which come into contact with the intermediate transfer member, wherein, in a case where the insulating particles are present in a contact region in which the protrusion brings into contact wish the intermediate transfer member, a portion in which the protrusion brings into direct contact with the superficial layer is present in the contact region.

Further features of the present invention will become apparent from the following description of exemplary embodiments with reference to the attached drawings.

DESCRIPTION OF THE EMBODIMENTS

An image forming apparatus of the present invention is hereinafter described in more detail with reference to the drawings.

First Embodiment

1. Entire Configuration and Operation of Image Forming Apparatus

Figure 1:
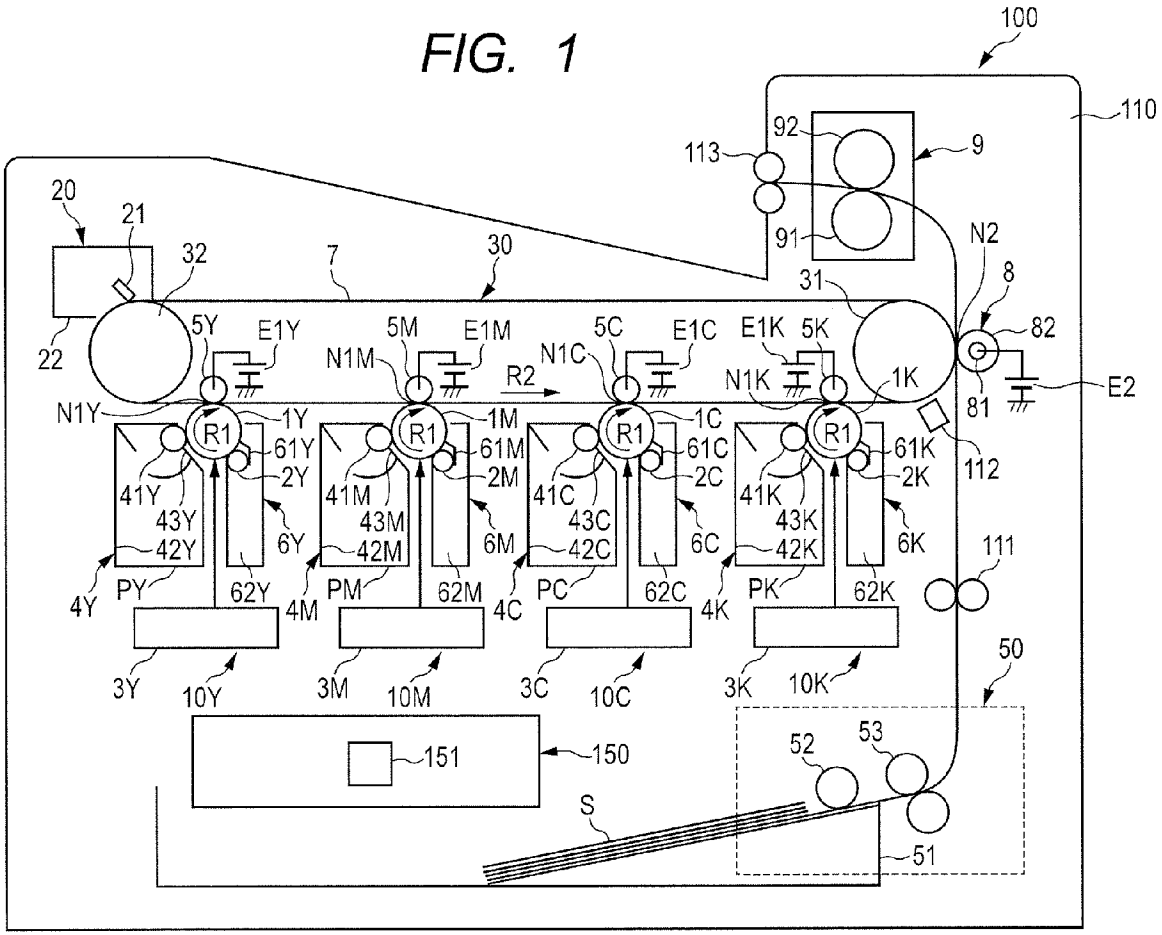
FIG. 1 is a schematic sectional view of an image forming apparatus according to an embodiment of the present invention.

FIG. 1 is a schematic sectional view illustrating an entire configuration of an image forming apparatus according to an embodiment of the present invention. An image forming apparatus 100 according to the embodiment is an in-line type (tandem type) full-color printer adopting an intermediate transfer system capable of forming, a full-color image.

The image forming apparatus 100 includes four image forming sections (stations) 10Y, 10M, 10C, and 10K as multiple image forming sections. In this embodiment, the four image forming sections 10Y, 10M, 10C, and 10K are arranged in a movement direction of an intermediate transfer belt described later. The respective image forming sections 10Y, 10M, 10C, and 10K form images of respective colors; yellow, magenta, cyan, and black successively from an upstream side in the movement direction of an image transferred surface (front surface) of the intermediate transfer belt.

In this embodiment, the configuration and operation of the respective image forming sections 10Y, 10M, 10C, and 10K are substantially the same except that the colors of toners to be used are different. Thus, unless distinction is necessary, the image forming sections 10Y, 10M, 10C, and 10K are collectively described with rip omission or the suffix symbols Y, M, C, and K in the drawings which respectively represent any of elements of the image forming sections 10Y, 10M, 10C, and 10K.

The image forming section 10 includes a photosensitive drum 1 which is a drum-shaped (cylindrical) electrophotographic photosensitive member (photosensitive member) serving as an image bearing member. The photosensitive drum 1 is rotationally driven in a direction of an arrow R1 in FIG. 1 by a driving motor (not shown) serving as a driving device. Respective devices are arranged successively around the photosensitive drum 1 in a rotation direction of the photosensitive drum 1. First, a roller-shaped charging roller 2 serving as a charging device is disposed. Next, a laser scanner 3 serving as an exposure device is disposed. Next, a developing device 4 is disposed. Next, a roller-shaped primary transfer roller 5 serving as a primary transfer device is disposed. Next, a drum cleaner 6 serving as a photosensitive member cleaning device is disposed.

An intermediate transfer belt unit 30 for transferring a toner image on the photosensitive drum 1 onto a transfer material S such as a recording sheet is disposed so as to be opposed to the photosensitive drums 1 of the image forming sections 10. The intermediate transfer belt unit 30 has an intermediate transfer belt 7 in an endless belt shape serving as a movable intermediate transfer member (movable member) so that the intermediate transfer belt 7 is opposed to the photosensitive drums 1 of the image forming sections 10. The intermediate transfer belt 7 is looped around two tension rollers (tension members), that is a driving roller 31 and a tension roller 32, and keeps appropriate tension. The intermediate transfer belt 7 moves circumferentially (rotates) in a direction of an arrow R2 in FIG. 1 by rotationally driving the driving roller 31 is. In this embodiment, the movement speed (peripheral speed) of the surface of the photosensitive drum 1 is substantially the same as that of the surface of the intermediate transfer belt 7, and the photosensitive drum 1 and the intermediate transfer belt 7 move in a forward direction in an opposed portion. On an inner circumferential surface (back surface) side of the intermediate transfer belt 7, the respective primary transfer rollers 5 are disposed at respective positions corresponding to the respective photosensitive drums 1 with the intermediate transfer belt 7 interposed therebetween. The primary transfer roller 5 is pressed against the photosensitive drum 1 through intermediation of the intermediate transfer belt 7. Consequently, a primary transfer section (primary transfer nip) N1 in which the photosensitive drum 1 and the intermediate transfer belt 7 are held in contact with each other is formed. On an outer circumferential surface (front surface) side of the in termed, rate transfer belt 7, a secondary transfer roller 8 which is a roller-shaped, secondary transfer member serving as a secondary transfer device is disposed at a position opposed to the driving roller 31 with the intermediate transfer belt 7 interposed therebetween. The secondary transfer roller 8 is pressed against the driving roller 31 through intermediation of the intermediate transfer belt 7. Consequently, a secondary transfer section (secondary transfer nip) N2 in which the intermediate transfer belt 7 and the secondary transfer roller 8 are field in contact with each other is formed. A belt cleaner 20 serving as an intermediate transfer member cleaning device is disposed at a position opposed, to the tension roller 32 with the intermediate transfer belt 7 interposed therebetween.

In the image forming apparatus 100, a feeding and conveying device 50 and registration rollers 111 for supplying the transfer material S to the secondary transfer section N2 and a fixing device 9 for fixing a toner image to the transfer material 3 are provided.

During image formation, the surface of the photosensitive drum 1 which rotates at a predetermined peripheral speed (process speed) is uniformly charged to a predetermined potential of predetermined polarity (negative polarity in this embodiment) by one charging roller 2. At this time, a predetermined, charging bias is applied to the charging roller 2 from a charging power source (not shown). The circumferential surface of the charged photosensitive drum 1 is scanned by and exposed to laser light by the exposure device 3 in accordance with image information, with the result that an electrostatic latent image (electrostatic image) in accordance with the image information is formed on the photosensitive drum 1. The electrostatic latent image formed on the photosensitive drum 1 is developed as a toner image by the developing device 4. The toner image formed on the photosensitive drum 1 is transferred (primarily-transferred) onto the intermediate transfer belt 7 owing to the function of the primary transfer roller 5 in the primary transfer section N1. At this time, a primary transfer bias which is a DC voltage having polarity (positive polarity in this embodiment) opposite to tire charging polarity (normal charging polarity) of toner during development is applied to the primary transfer roller 5 from a primary transfer power source E1. For example, during formation of a full-color image, the above-mentioned process is performed successively in the four image forming sections 10Y, 10M, 10C, and 10K, and toner images of respective colors are successively overlapped with each other and primarily-transferred onto the intermediate transfer belt 7. Thus, a multi-toner image for a full-color image is formed on the intermediate transfer belt 7. In each image forming section 10, an electrostatic latent image is formed on each photosensitive drum 1 with a delay of predetermined timing in accordance with the distance between the adjacent primary transfer sections N1.

The toner image on the intermediate transfer belt 7 is transferred (secondarily-transferred) onto the transfer material S owing to the function of the secondary transfer roller 8 in the secondary transfer section N2. At this time, a secondary transfer bias which is a DC voltage having polarity (positive polarity in this embodiment) opposite to the charging polarity of toner during development is applied to the secondary transfer roller 8 from a secondary transfer power source E2. In the feeding and conveying device 50, the transfer materials S are separately fed one by one from a cassette 51 containing the transfer materials S by a feed roller 52 and conveyed by a conveyance roller pair 53. After that, the transfer material S conveyed from the feeding and conveying device 50 is conveyed to the secondary transfer section N2 in synchronisation with the toner image on the intermediate transfer belt 7 by the registration rollers 111.

The transfer material 8 with the toner image transferred, thereto is conveyed to the fixing device 9. When the transfer material S passes through the fixing device 9, the transfer material S is heated, and pressed by being nipped and conveyed by a fixing film 91 and a pressure roller 92, with the result that the toner image is fixed to the surface of the transfer material S. Then, the transfer material S with the toner image fixed thereto is delivered outside of an apparatus main body 110 of the image forming apparatus 100 by a delivery roller pair 113.

Toner (primary transfer residual toner) remaining on the photosensitive drum 1 after the primary transfer step is removed and collected by the drum cleaner 6. The drum cleaner 6 scrapes the toner from the surface of the rotating photosensitive drum 1 with a cleaning blade 61 serving as a cleaning member, which comes into contact with the photosensitive drum 1, and the drum cleaner a collects to a toner container 62. Toner (secondary transfer residual toner) remaining on the intermediate transfer belt 7 after the secondary transfer step is removed and collected by the belt cleaner 20. The belt cleaner 20 scrapes the toner from the surface of the rotating intermediate transfer belt 7 with a cleaning blade 21 serving as a cleaning members which comes into contact with the intermediate transfer belt 7, and the belt cleaner 20 collects to a toner container 22. The cleaning blade 21 comes into contact with the intermediate transfer belt 7 on an upstream side of the primary transfer section N1Y of the uppermost scream side image forming section 102 and on the downstream side of the secondary transfer section N2 in the movement direction of the intermediate transfer belt 7 and scrapes the tones on the moving intermediate transfer belt 7.

The image forming apparatus 100 includes a color misregistration detection sensor 112 serving as an optical sensor. Then, the image forming apparatus 100 detects a toner pattern for calibration formed on the intermediate transfer belt 7 at predetermined timing with the color misregistration detection, sensor 112 and controls image formation timing in each lavage forming section 10. The color misregistration detection sensor 112 is provided in the vicinity of the driving roller 31.

In this embodiment, the photosensitive drum 1 is configured by applying an organic photo-conductive layer (organic photoconductor (OPC) photosensitive member) to an outer circumferential surface of a cylinder made of aluminum. Both ends in a longitudinal direction (rotation axis direction) of the photosensitive drum 1 are rotatably supported by support members (not shown), and the photosensitive drum 1 is rotationally driven in the direction of the arrow R1 in FIG. 1 when a driving force is transmitted to one end of the photosensitive drum 1 from a driving motor.

In this embodiment, the charging device includes the conductive roller (charging roller) 2. The charging roller 2 is brought into contact with the surface of the photosensitive drum 1. When a predetermined charging bias is applied to the charging roller 2 from a charging power source (not shown), the surface of the photosensitive drum 1 is uniformly charged. In this embodiment, a DC voltage equal to or higher than a negative discharge starting voltage is applied as a charging bias to the charging roller 2, and the surface of the photosensitive drum 1 is charged to predetermined negative potential (dark part potential).

In this embodiment, the laser scanner 3 scans the photosensitive drum 1 through use of a polygon mirror or the like and irradiates the photosensitive drum 1 with laser light (laser beam) modulated based on an image signal. Lighting of laser light is controlled by a driving circuit (not shown) in accordance with the image signal, and the surface of the charged photosensitive drum 1 is selectively exposed, with the result that an electrostatic latent image is formed on the photosensitive drum 1.

In this embodiment, the developing device 4 includes a developing roller 41 serving as a developer bearing member, a developing container 42 for containing toner to be supplied to the developing roller 41, and a developing blade 43 serving as a developer regulating member for regulating the amount of toner on the developing roller 41 and applying charge to toner. The developing device 4 causes toner charged to she same polarity (negative polarity in this embodiment) as the charging polarity of the photosensitive drum 1 to adhere to a laser beam irradiation portion (light part potential) in an electrostatic latent image on the photosensitive drum 1, thereby developing the electrostatic latent image on the photosensitive drum 1 as a toner image (reversal development). The developing containers 42Y, 42M, 42C, and 42K of the respective image forming sessions 10Y, 10M, 10C, and 10K contain toners of respective colors (yellow, magenta, cyan, black) as a developer. In particular, in this embodiment, the developing containers 42Y, 42M, 42C, and 42K contain a non-magnetic one-component developer (toner). The toner is conveyed from the developing container 42 to the developing roller 41, and then, the toner, which adheres to the developing roller 41, is charged to uniform polarity (negative polarity in this embodiment) by friction between the toner and the developing blade 43. At least during the development step, the developing roller 41 is brought into contact with the photosensitive drum 1. A negative developing bias whose absolute value is smaller than a dark part potential and is larger than a light part potential is applied to the developing roller 41 from a developing power scarce (not shown). Thus, the toner is allowed to adhere to only a region corresponding to the light part potential in toe electrostatic latent image. The toner has a particle diameter of about 5 to 6 μm.

In this embodiment, the photosensitive drum 1, and the charging roller 2, the developing devise 4, and the drum cleaner 6 serving as process devices which act on the photosensitive drum 1 are integrally formed in a frame as a process cartridge P so as to be detachably mounted on the apparatus main body 110 of the image forming apparatus 100.

In this embodiment, the intermediate transfer belt 7, the tension rollers 31 and 32 for the intermediate transfer belt 7, and the belt cleaner 20 provided in the intermediate transfer belt unit 30 are integrally formed in a frame so as to be detachably mounted on the apparatus main body 110 of the image forming apparatus 100.

In the image forming apparatus 100, a control board (control section) 150 on which an electric circuit for controlling each section, of the image forming apparatus 100 is provided. On the control board 150, a central processing unit (CPU) 151 serving as a control device, a memory (not shown) serving as a storage device storing various control information, and the like are mounted. The CPU 151 controls the operation of the image forming apparatus 100 at a time. For example, the CPU 151 controls: a driving source regarding the conveyance of the transfer material S and a driving source of the intermediate transfer belt 7 and the process cartridge P; image formation; and further, detection of failures.

2. Secondary Transfer Roller

Next, the secondary transfer roller 8 in this embodiment is described.

In this embodiment, the secondary transfer roller 8 has a configuration in which a cored bar 81 is coated with an elastic layer 82 made of a foamed elastic layer. In this embodiment, the secondary transfer roller 8 is produced as follows. First, a material containing nitrile butadiene rubber (NBR) and epichlorohydrin rubber as main components is supplied to a kneader. The supplied material is kneaded and extruded from the kneader. Then, the obtained preform is vulcanized in a vulcanizer, and a metallic shaft, (outer diameter: 6 mm) serving as a cored bar is inserted into the preform. The resultant preform is shaped by polishing to an outer diameter of 18 mm, and thereafter, excess parts of the preform at both ends in a longitudinal direction (rotation axis direction) are cut away. In this embodiment, the secondary transfer roller S is a foamed roller obtained as described above.

Figure 3:
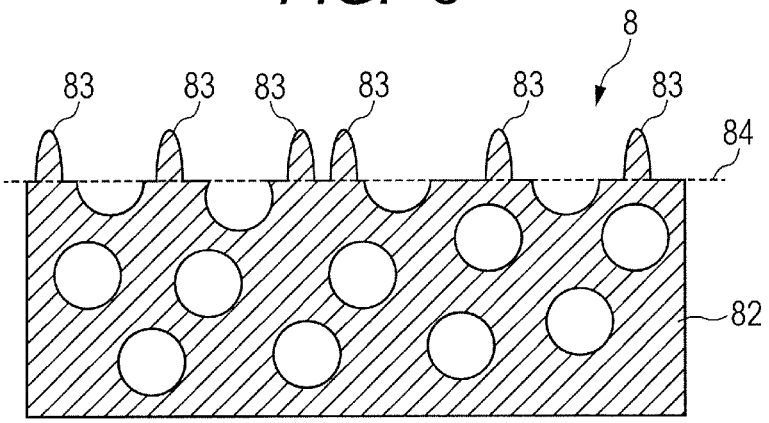
FIG. 3 is a schematic sectional view of a secondary transfer roller which can be used in the embodiment of the present invention.

FIG. 3 is a schematic sectional view of a vicinity of the surface of the polished secondary transfer roller 8. The secondary transfer roller 5 is polished with a grindstone by pressing the grindstone against the surface of the secondary transfer roller S while rotating. Therefore, as illustrated in FIG. 3, minute protruding sections protruding from a finished polished surface 84 remain locally on the surface of the secondary transfer roller 8. The minute protruding sections are referred to as "protrusions" 83.

In this embodiment, the secondary transfer roller 8 is pressed against the intermediate transfer belt 7 with a pressure spring which as an elastic member serving as a biasing device at both ends of the secondary transfer roller 8 in a longitudinal direction (rotation axis direction) thereof. In this embodiment, the secondary transfer roller 8 is pressed against the intermediate transfer belt 7 under a pressure force of 50 N. Then, the secondary transfer roller 8 is driven to rotate along with the movement of the intermediate transfer belt 7.

According to the study by the inventor(s) of the present invention, it is known that portions, in which a superficial layer 7*a* of the intermediate transfer belt 7 and the secondary transfer roller 8 are actually held in contact with each other, mainly correspond to parts of the protrusions 83 (described later in derail).

3. Method of Measuring Area of Contact Region Between Protrusion of Secondary Transfer Roller and Superficial Layer of Intermediate Transfer Belt Next, a method of measuring an area of a contact region in which the protrusion 83 of the secondary transfer roller 8 and the superficial layer 7*a* of the intermediate transfer belt 7 are hold in contact with each other (hereinafter, sometimes referred to as "contact region of a protrusion" or simply as "contact region") is described.

Figure 4:
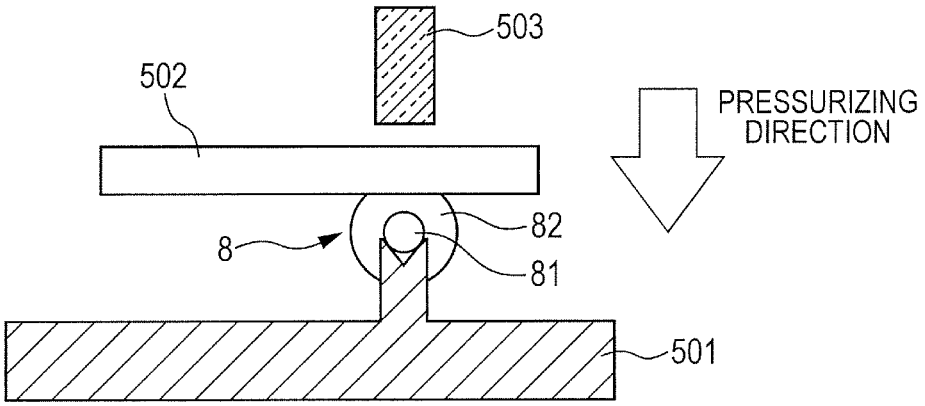
FIG. 4 is a schematic view illustrating a measurement device for a contact region of a protrusion of the secondary transfer roller.

As illustrated in FIG. 4, a glass plate 502 simulated as the superficial layer 7*a* (described later) of the intermediate transfer belt 7 is pressed against the secondary transfer roller 8 set on a support member (microscope stage) 501 under the same pressure force (50 N in this case) as that of an actual device. Then, an area of a region in which the protrusion 63 comes into contact with the glass plate 502 through intermediation of the glass plate 502 is obtained through use of a confocal microscope ("OPTELICS S130" manufactured by Lasertec Corporation) 503. The contact region of the protrusion 33 varies to some degree depending on the protrusion 83. However, the area of the contact region of the protrusion 83 can be obtained, for example, by averaging areas of the contact regions of the respective protrusions 83 by a viewing angle of an about 1 mm square region (1 mm×1 mm) in the secondary transfer roller 8 produced by the production method as described above.

Figure 8:
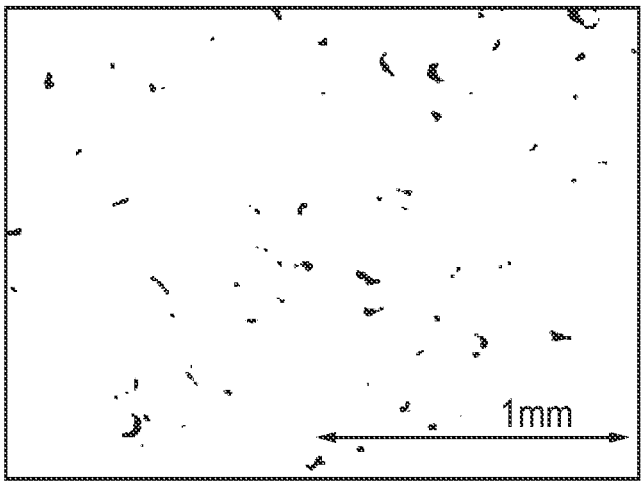
FIG. 8 is a photograph showing an example of observation results of contact regions of protrusions.

FIG. 8 shows an example of observation results of the secondary transfer roller 8 in this embodiment. In FIG. 3, regions in which an image is formed in black correspond to contact regions of the protrusions 83.

Even when the pressure force of the secondary transfer roller 8 is increased, images formed in black due to the contact between the secondary transfer roller 8 and the glass 502 substantially correspond to only the protrusions 83, and the finished polished surface 84 (FIG. 3) does not come into contact with tire glass 502. The finished polished surface 84 is made of the same material as that for the protrusions 83, and hence has the same modulus of elasticity as that of the protrusions 83. Therefore, even when the pressure force is increased, the finished polished surface 84 is pressed by the protrusions 83 and shrunk accordingly, with the result that it becomes difficult for the finished polished surface 84 to come into contact with the glass surface 502.

The contact region of one protrusion 83 has a dimension of about 10 to 30 μm×50 to 200 μm in terms of sizes in two directions orthogonal to each other. Then, about 5 to 20 protrusions 83 are present in a range of a viewing angle of a 1 mm square region.

Regarding the protrusions 83 whose contact region has a dimension of 10 μm or less in terms of any one of the sizes in two directions orthogonal to each other, it is difficult to visually recognise the protrusions 83 on an image, and hence those protrusions 83 may be ignored.

4. Intermediate Transfer Belt

Figure 2A:
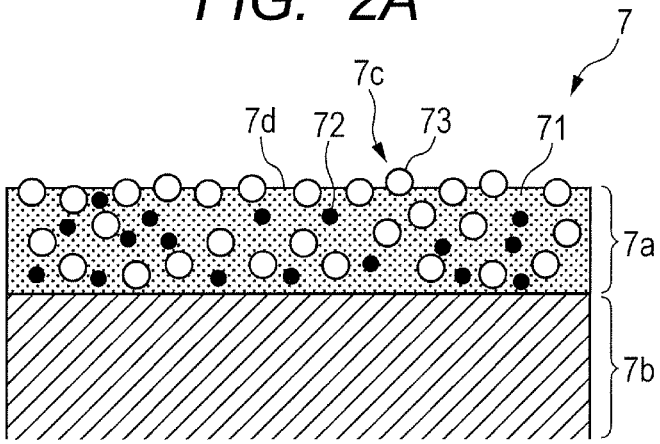
FIG. 2A is a schematic sectional view illustrating an example of a layer configuration of an intermediate transfer belt according to the embodiment of the present invention.
Figure 2B:
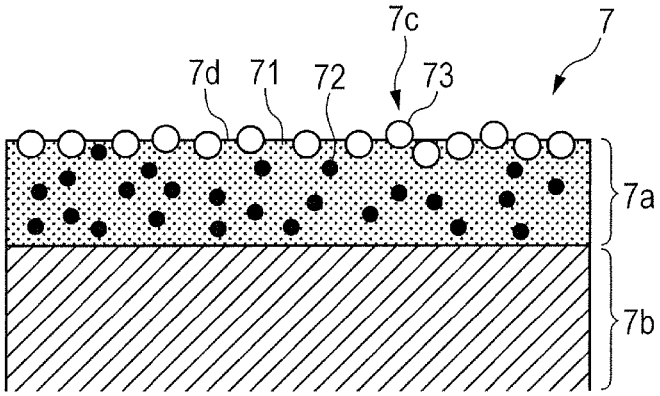
FIG. 2B is a schematic sectional view illustrating an example of a layer configuration of the intermediate transfer belt according to the embodiment of the present invention.
Figure 2C:
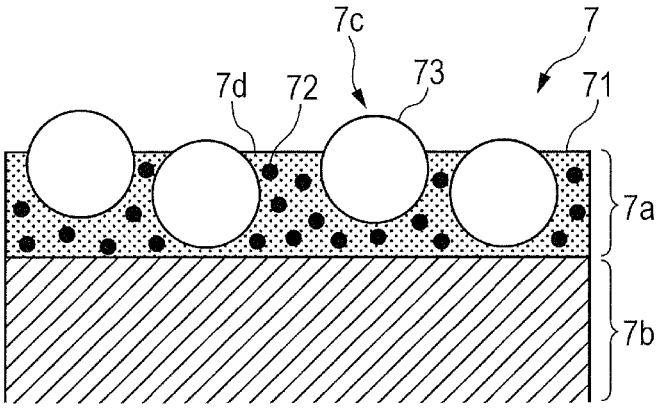
FIG. 2C is a schematic sectional view illustrating an example of a layer configuration of the intermediate transfer belt according to the embodiment of the present invention.

Next, the intermediate transfer belt 7 in this embodiment is further described. FIGS. 2A, 2B, and 2C schematically illustrate some examples of a layer configuration of the intermediate transfer belt 7.

In this embodiment, the intermediate transfer belt 7 is formed of two layers: a bass layer 7*b* and the superficial layer 7*a*. The superficial layer 7*a* carries (holds) a toner transferred from the photosensitive drum 1. The superficial layer 7*a* is formed on the base layer 7*b*.

As a material for the base layer 7*b*, there are given, for example, thermoplastic resins such as polycarbonate, polyvinylidene fluoride (PVDF), polyethylene, polypropylene, polymethylpentene-1, polystyrene, polyamide, polysulfone, polyarylate, polyethylene terephthalate, polybutylene terephthalate, polyethylene naphthalate, polybutylene naphthalate, polyphenylene sulfide, polyether sulfone, polyether nitrile, thermoplastic polyimide, polyether ether ketone, a thermotropic liquid crystal polymer, and polyamic acid. Two or more kinds of those materials can be used as a mixture.

The base layer 7*b* of the intermediate transfer belt can be obtained by: melting and kneading a conductive agent or the like into any such thermoplastic resin; and then molding the resultant by a molding method appropriately selected from, for example, inflation molding, cylindrical extrusion molding, and injection stretch blow molding.

It is preferred that a curable material which is cured, by irradiation of heat or an energy ray such as light (ultraviolet (UV) light, etc.) or an electron beam be used for the superficial layer 7*a* from the viewpoint of increasing the hardness of the surface of the intermediate transfer belt 7 so as to enhance the durability (abrasion resistance) thereof. In particular, a curable material having high curing property, which is cured by irradiation of UV light or an electron beam, is preferred, but the present invention is not limited thereto. Of the curable materials, as organic materials, for example, there are given curable resins such as a melamine resin, a urethane resin, an alkyd resin, an acrylic resin, and a fluorine-based curable resin (fluorine-containing curable resin). In addition, as inorganic materials, for example, there are given an alkoxysilane-alkoxyzirconium-based material and a silicate-based material. In addition, as organic and inorganic hybrid materials, for example, there are given an inorganic fine particle-dispersed organic polymer-based material, an inorganic fine particle-dispersed organoalkoxysilane-based material, an acrylic silicon-based material, and an organoalkoxysilane-based material. Of the curable materials, resin materials (curable resins) are preferred from the viewpoint of strength such as abrasion resistance and cracking resistance of the superficial layer 7*a* or the intermediate transfer belt 7. Or the curable resins, an acrylic resin obtained by curing an unsaturated double bond-containing acrylic copolymer is preferred. As the unsaturated double bond-containing acrylic copolymer, for example, an acrylic UV-curable resin ("OPSTAR Z7501" manufactured by JSR Corporation) can be used. That is, it is preferred that tee intermediate transfer belt 7 have she superficial layer (cured film, surface cured layer) 7*a* obtained, by irradiating a liquid containing a UV-curable monomer end/or oligomer component with an energy ray so as to cure the liquid.

A conductive agent (conductive filler, electric resistance adjusting agent) 72 is added to the superficial layer 7*a* for the purpose of suppressing charge-up. As the conductive agent 72, an electron conductive agent or an ion conductive agent can be used. Examples of the electron conductive agent include: a particulate, fibrous, or flaky carbon-based conductive filler such as carbon black, a PAN-based carbon fiber, or ground expanded graphite; a particulate, fibrous, or flaky metal-based conductive filler of silver, nickel, copper, zinc, aluminum, stainless steel, iron, or the like; and a particulate metal oxide-based conductive filler of sine antimonate, antimony-doped tin oxide, antimony-doped zinc oxide, tin-doped indium oxide, aluminum-doped sine oxide, or the like. Examples of the ion conductive agent include an ionic liquid, a conductive oligomer, and a quaternary ammonium salt. One or more kinds are appropriately selected from those conductive agents. In addition, the electron conductive agent and the ion conductive agent may be used as a mixture. Of those, a particulate metal oxide-based conductive filler (particles having a submicron size or less, etc.) is preferred from the viewpoint that a small addition amount suffices.

Superficial layer particles 73 are added to the superficial layer 7*a* for the purpose of enhancing transfer efficiency. The superficial layer particles 73 are preferably a solid lubricant, and are generally insulating particles. As the superficial layer particles 73, there may be used ones appropriately selected from polytetrafluoroethylene (PTFE) resin powder, trifluorochloroethylene resin powders tetrafluoroethylene-hexafluoropropylene resin powder, vinyl fluoride resin powder, vinylidene fluoride resin powder, difluorodichloroethylene resin powder, fluorine-containing particles of graphite fluoride and the like, and copolymers thereof. The superficial layer particles 73 are not necessarily limited thereto, and may be a solid lubricant such as silicone resin particles, silica particles, and molybdenum disulfide powder. Of those, polytetrafluoroethylene (PTFE) resin particles (emulsion-polymerized PTFE resin particles, etc.) are preferred from the viewpoints of having a low friction coefficient of the surface of particles and of being capable of reducing the friction of another member (for example, the cleaning blade 21) which comes into contact with she surface of the intermediate transfer belt 7.

An example of a method of producing the superficial layer 7*a* is schematically described as follows. Zinc antimonate particles serving as a conductive agent and PTFE particles serving as a solid lubricant are mixed in an unsaturated double bond-containing acrylic copolymer, and the particles are dispersed and mixed by a high-pressure emulsification dispersing machine to produce a coating liquid for forming a superficial layer.

As a method of forming the superficial layer 7*a* on the base layer 7*b*, there may be given, for example, general coating methods such as dip coating, spray coating, roll coating, and spin coating. The method, appropriately selected from those methods can result in the formation of the superficial layer 7*a* having a desired thickness.

5. Protrusions of Secondary Transfer Roller and Superficial Layer Particles of Intermediate Transfer Belt In the related-art configuration described in Japanese Patent Application Laid Open No. 2009-75154, the superficial layer of the intermediate transfer belt and the particles buried therein have an insulation property without being adjusted for electric resistance, and more insulating particles are exposed from, the surface of the intermediate transfer belt. Therefore, image defects may occur when charging up the intermediate transfer belt, in particular, charging up the particles. This phenomenon is further described with reference to FIG. 9A, FIG. 9B and FIG. 9C.

Figure 9A:
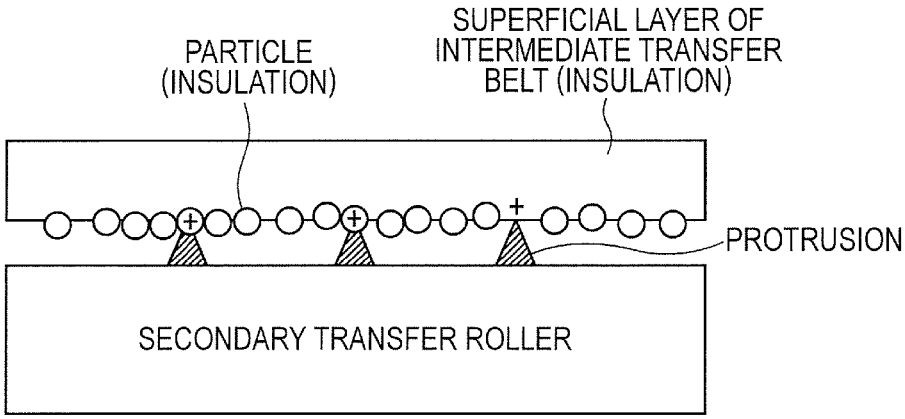
FIG. 9A is a schematic enlarged sectional view of a secondary transfer section for illustrating a conventional problem.

FIG. 9A is a schematic enlarged view or a secondary transfer section of the related-art in which particles are buried in a superficial layer of an intermediate transfer belt. A secondary transfer roller is formed by polishing foamed sponge-like rubber with a grindstone, and hence protruding sections referred to as protrusions are present on the surface of the secondary transfer roller. Then, parts of the protrusions on the surface of the secondary transfer roller mainly come into contact with the superficial layer of the intermediate transfer belt. When a positive voltage is applied to the secondary transfer roller, and a toner image is secondarily-transferred from the intermediate transfer belt onto the transfer material, positive charge is injected from the protrusions of the secondary transfer roller to the intermediate transfer belt. In this case, the superficial layer of the intermediate transfer belt and the particles buried in the superficial layer have an insulation property, and hence only parts with which the protrusions have come into contact, in particular, particles are likely to be positively charged up locally (parts represented by a symbol "+" in FIG. 9A), and an electrostatic potential is formed easily on the superficial layer of the intermediate transfer belt.

Figure 9B:
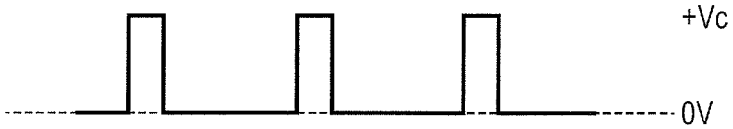
FIG. 9B is an electrostatic potential diagram illustrating the conventional problem.

FIG. 9B is a schematic diagram of she electrostatic potential. In the superficial layer of the intermediate transfer belt and the particles buried therein, a potential Vc is likely to be formed only in the parts with which the protrusions have come into contact. The value of Vc is about +20 V to about +100 V.

Figure 9C:
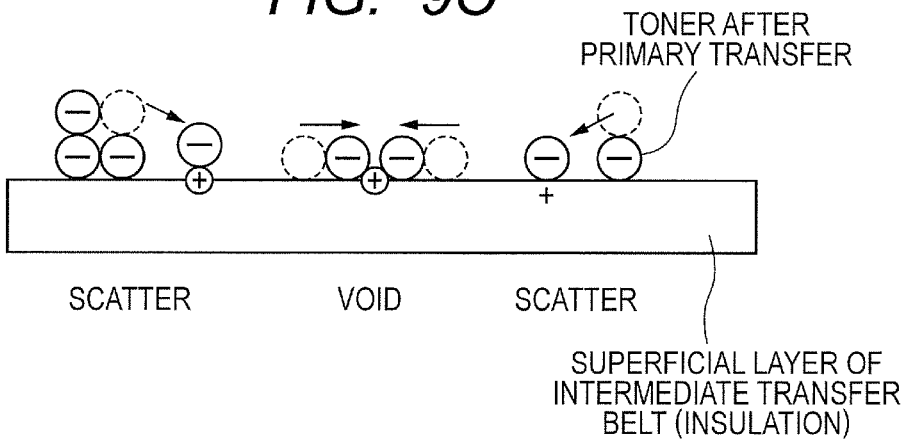
FIG. 9C is a schematic view of image defects caused by charge-up for illustrating the conventional problem.

The superficial layer of the intermediate transfer belt end the particles buried therein have an insulation property. Therefore, the electrostatic potential formed during secondary transfer is kept until primary transfer of a subsequent image while being hardly attenuated. Consequently, after the subsequent image is primarily-transferred to the intermediate transfer belt, the negative toner on the intermediate transfer belt receives an electrostatic force from the electrostatic potential (positive polarity) of the superficial layer of the intermediate transfer belt and the particles buried therein to move as if the toner is attracted to an electrostatic potential section as illustrated in FIG. 9C. This phenomenon may cause image defects called scatter (image in which toner looks scattering from an original image position; and a void (image in which a toner is lost from an original image position), depending on the image pattern.

It is known owing to the study by the inventor(s) of the present invention that this phenomenon tends to occur when a positive voltage is applied to the secondary transfer roller in a state where the superficial, layer of the intermediate transfer belt and the secondary transfer roller come into direct contact with each other in a segment, called a sheet interval between the transfer materials.

One object of this embodiment is to suppress image defects caused by charge-up of the intermediate transfer belt in the configuration in which the particles are exposed from the surface or the intermediate transfer belt so as to enhance transfer efficiency.

FIG. 2A is a schematic enlarged partial sectional view of a vicinity of the superficial layer 7*a* illustrating an example of the layer configuration of the intermediate transfer belt 7 in this embodiment.

In this embodiment, the intermediate transfer belt 7 is farmed as an endless film-shaped member, and is formed of two layers: the base layer (base member) 7*b* and the superficial layer (surface layer) 7*a* as described above.

As an example, the base layer 7*b* is a layer having a thickness of 70 μm obtained by dispersing carbon black as an electric resistance adjusting agent in a polyethylene naphthalate resin. As an example, the superficial layer 7*a* is a layer having a thickness of 3 μm obtained by dispersing sine antimonate particles serving as the conductive agent 72 in an acrylic resin serving as a curable material 71 and adding PTFE panicles serving as the superficial layer particles 73 to the resultant acrylic resin.

In this embodiment, the intermediate transfer belt 7 has a width (length in a direction substantially orthogonal to a movement direction) of 246 nm and a circumferential length of 712 nm.

The superficial layer particles 73 added to the superficial layer 7*a* of she intermediate transfer belt 7 protrude (precipitate) to the surface (outermost surface layer) and form, protruding shapes 7*c* with a part thereof being exposed. The superficial layer particles 73 are present in a state of being also dispersed in the superficial layer 7*a* (on the side closer to the base layer 7*b* in a deeper part).

The projected area of an exposed portion of one superficial layer particle 73 is smaller than the area of a contact region of one protrusion 83 of the secondary transfer roller 8. In she contact region of one protrusion 83 of the secondary transfer roller 8, a portion is present in which the protrusion 33 end a region 7*d* other than the superficial layer particle 73 of the superficial layer 7*a* of the intermediate transfer belt 7 (hereinafter sometimes referred to as "superficial layer main body") are held in contact with each other.

The projected area of the exposed portion of one superficial layer particle 73 can be measured by observation with a microscope. A specific measurement method is described later.

Preferably, the proportion of tire projected area of the exposed portion of the superficial layer particle 73 on the surface of the intermediate transfer belt 7 (hereinafter sometimes referred to as "particle projected area ratio") is in a range of 10% to 80%, when the particle, projected area ratio is smaller than 10%, the effect of enhancing secondary transfer efficiency by improving a releasing property may not be obtained. Further, when the particle projected area ratio is more than 80%, it becomes difficult for the protrusion 83 to come into contact with the superficial layer main body 7*d*, and image defects caused by charge-up may occur. The particle projected area ratio is more preferably 40% to 70%.

The particle projected area ratio can be measured by observation with a microscope. A specific measurement method is described later. A particle projected area ratio determined by measurement can represent a ratio (%) of she total of the projected areas of the exposed portions of she superficial layer particles 73 with respect to the entire surface a sea of the superficial layer 7*a* of the intermediate transfer belt 7.

In order to obtain the effects of the superficial layer particles 73, it is appropriate that the superficial layer particles 73 are exposed from the surface of the intermediate transfer belt 7 and further that the contact region of the secondary transfer roller 8 satisfies the above-mentioned condition. Therefore, as illustrated in FIG. 2B, the superficial lawyer particles 73 may be present only on the surface side of the intermediate transfer belt 7. Similarly, as illustrated in FIG. 2C, the superficial, layer particles 73 having a relatively large particle diameter may be contained in the superficial layer 7*a* of the intermediate transfer belt 7 and exposed from the surface of the intermediate transfer belt 7.

The superficial layer particles 73 may be unevenly distributed on the surface side in a thickness direction of the superficial layer 7*a*. However, it is preferred that the superficial layer particles 73 are substantially uniformly dispersed on the surface of the intermediate transfer belt 7.

As an example, in this embodiment, the intermediate transfer belt 7 has a volume resistivity of $10^{10}$ Ω·cm. It is preferred that the volume resistivity of the intermediate transfer belt 7 as in a range of $10^{9}$ to $10^{12}$ Ω·cm from the viewpoint of forming a satisfactory image.

The superficial layer main body 7*d* of the intermediate transfer belt 7 has conductivity, and the volume resistivity of the superficial layer main body 7*d* is in a range of $10^{9}$ to $10^{12}$ Ω·cm. When the volume resistivity of the superficial layer main body 7*d* is less than the above-mentioned range, transfer defects may be caused by transfer current release, in particular, in a high-temperature and high-humidify environment. Further, when the volume resistivity of the superficial layer main body 7*d* exceeds the above-mentioned range, image defects may occur due to charge-up. The superficial layer particles 73 added to the superficial layer 7*a* of the intermediate transfer belt 7 have an insulation property. In this case, the insulation property refers to a volume resistivity of $10^{14}$ Ω·cm or more, and in this embodiment, particles having a volume resistivity of $10^{18}$ Ω·cm were used.

A value of a volume resistivity was measured in an environment at a temperature of 25° C. and a relative humidity of 50% through use of a general-purpose measurement unit ("Hiresta•UFMCP-HT450" manufactured by Mitsubishi Chemical Corporation).

In this embodiment, the superficial layer 7*a* of the intermediate transfer belt 7 includes the conductive superficial layer main body having electric resistance adjusted (curable material 71 having electric resistance adjusted by the conductive agent 72) 7*d* and the insulating superficial layer particles 73 buried in the superficial layer main body 7*d* so as to be partially exposed therefrom. The projected area of the exposed portion of one superficial layer particle 73 is smaller than the area of a contact region of one protrusion 83 of the secondary transfer roller 8. In the contact region of one protrusion 83 oil the secondary transfer roller 8, a portion is present in which the protrusion 83 and the superficial layer main body 7*d* of the intermediate transfer belt 7 are held in contact with each other. Preferably, the particle projected area ratio is 10% to 80%.

Figure 5:
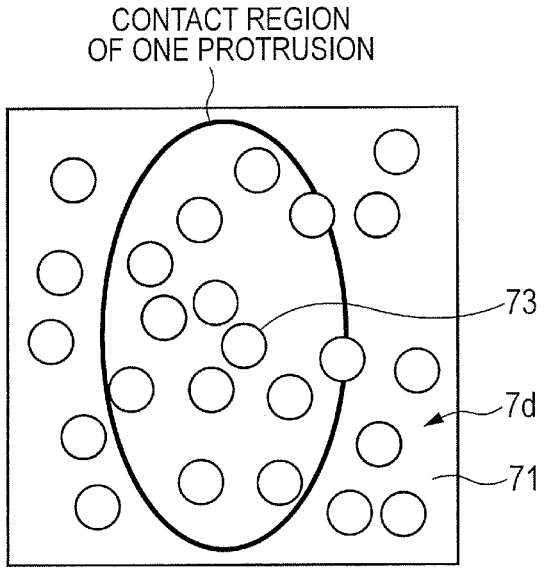
FIG. 5 is a schematic plan view illustrating a relationship between a projected area of superficial layer particles exposed from the surface of rise intermediate transfer belt and the contact region of the protrusion of the secondary transfer roller according to the embodiment of the present invention.
Figure 6:
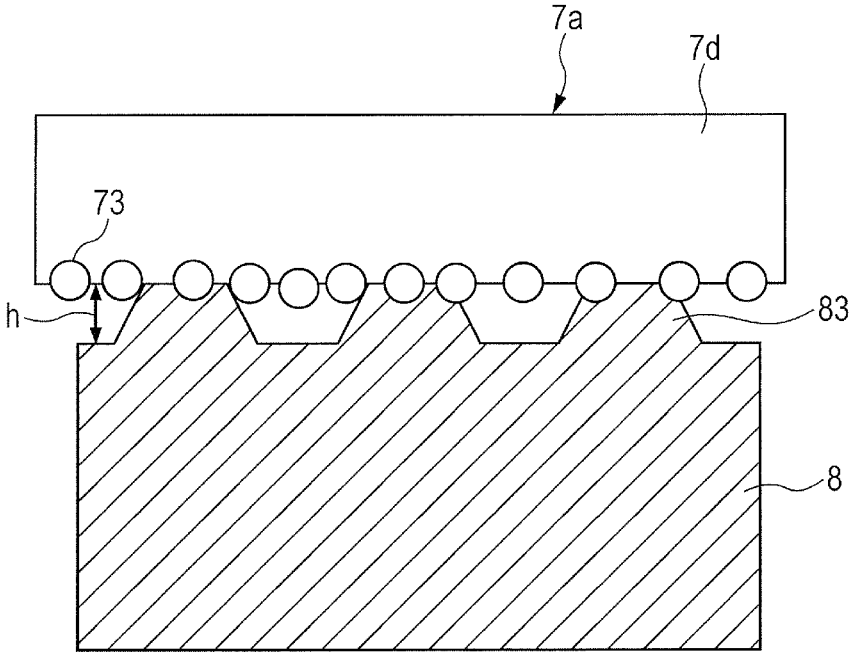
FIG. 6 is a schematic sectional view illustrating a relationship between a projected area of superficial layer particles exposed from the surface of the intermediate transfer belt and the contact region of the protrusion of the secondary transfer roller according to the embodiment of the present invention.

FIGS. 5 and 6 illustrate a relationship between a contact region of one protrusion 83 and the projected area of the superficial layer particles 73 exposed from the surface or the intermediate transfer belt 7 in a state where the secondary transfer belt 8 and the intermediate transfer belt 7 are held in contact with each other. FIG. 5 illustrates a state viewed in a direction substantially orthogonal to the surface of the intermediate transfer belt 7, and FIG. 6 illustrates a state viewed in a sectional direction substantially orthogonal to the surface of the intermediate transfer belt 7.

In this embodiment, the projected area of the exposed portion of one superficial layer particle 73 is small and the particle projected area ratio thereof is 10% to 80% with respect to the contact region of one protrusion 83, and the superficial layer particles 73 are arranged with an appropriate interval therebetween. Therefore, there always exists a portion in which the protrusion 85 and the superficial layer main body 7*d* of the conductive intermediate transfer belt 7 having adjusted electric resistance are held in direct contact with each other.

In this embodiment, the protrusion 83 has a height (h in FIG. 6) of 100 μm to 600 μm. On the other hand, the superficial layer particle 73 has a height of hundreds of nm to thousands of nm. The protrusion 33 is part of the elastic layer made of a foamed elastic body, and hence the protrusion 83 is deformed in a region where the protrusion 83 comes into contact with the superficial layer particle 73 and part, of the protrusion 83 comes into direct contact with the intermediate transfer belt 7.

In this embodiment, when a positive voltage is applied to the secondary transfer roller 8, and positive charge is injected from the protrusion 83 to the superficial layer 7*a* of the intermediate transfer belt 7, a portion, in which the protrusion 83 and the superficial Layer main body 7*d* of the conductive intermediate transfer belt 7 having adjusted electric resistance are held in contact with each other, serves as a conducting path. Therefore, the charge-up of the insulating superficial layer particles 73 can be suppressed.

6. Examples and Comparative Examples

Next, the effects of this embodiment are described in more detail with referring to examples and comparative examples.

In all the examples and comparative examples; she secondary transfer roller 8 is produced by the above-mentioned production method, and the contact region of the protrusion 83 is about 20 μm×150 μm.

Example 1

In this example, the intermediate transfer belt 7 formed of two layers: the base layer 7*b* and the superficial layer 7*a*, was produced as follows, and the presence/absence of the occurrence of image defects caused by charge-up was cheeked.

Production of Base Layer

The base layer 7*b* of the intermediate transfer belt 7 was produced as follows.

A bottle-shaped molded article was obtained by subjecting a polyethylene naphthalate resin to stretch blow molding, and the molded article was cut with an ultrasonic cutter to obtain an endless belt body.

Carbon black was dispersed as an electric resistance adjusting agent in the polyethylene naphthalate resin.

The polyethylene naphthalate resin belt having a thickness of 70 μm thus obtained was used as the base layer 7*b* of the intermediate transfer belt 7.

Preparation of Coating Liquid for Forming Superficial Layer (UV-Curable Resin Composition)

A coating liquid for forming the superficial layer 7*a* of the intermediate, transfer belt 7 was prepared as follows.

In a container shielded, against UV light, 25 parts by weight of PTFE particles (Lubron L-2 manufactured by Daikin Industries, Ltd.) having a primary particle diameter of 200 nm serving as the superficial layer particles 73, 100 parts by weight of an unsaturated double bond-containing acrylic copolymer ("OPSTAR Z7501" manufactured by JSR Corporation) serving as the curable maternal 71, 50 parts by weight of methyl isobutyl ketone, and 48 parts by weight of zinc antimonate particle-containing isopropanol sol ("CELNAX CX-Z210IP" manufactured by Nissan Chemical Industries, Ltd.) serving as the conductive agent 72 were mixed. The respective components were dispersed and mixed by a high-pressure emulsification dispersing machine, and the prepared UV-curable resin composition was used as the coating liquid for forming the superficial layer 7*a* of the intermediate transfer belt 7.

The primary particle diameter of the superficial layer particles 73 was measured by the following method. Any four positions were selected from the produced intermediate transfer belt 7, and part of each of she obtained cress-section was cut out by a freezing superthin section method. Then, the positions were observed by a magnification of 60,000 with transmission electron microscopy (TEM) in a thickness direction of the belt to obtain a photograph. A maximum diameter (nm) was measured from the obtained, photograph in a thickness direction and a circumferential direction of the intermediate transfer belt 7 regarding at least 100 superficial layer particles 73, and the measured value was defined as a primary particle diameter. Then, a value obtained by averaging all the primary particle diameters was defined as a primary particle diameter in the present invention.

Production of Intermediate Transfer Belt Provided with Superficial Layer

The intermediate transfer belt 7 hating the superficial layer 7*a* formed on the base layer 7*b* was produced as follows.

The UV-curable resin composition prepared as described above was applied onto the base layer 7*b* produced as described above by dip coating in a coating environment at a temperature of 25° C. and a relative humidity of 60%.

After 10 seconds from the completion of the coating, the UV-curable resin composition was cured by irradiation of UV light through use of a UV light irradiation device (UE06/81-3 manufactured by Eye Graphics Co., Ltd., cumulative light amount: 1,000 mJ/cm$^2$) set in the same, place as that of the coating environment. Consequently, a cured resin film having a thickness of 3 μm was formed, and the cured resin film was used as the superficial layer 7*a* of the intermediate transfer belt 7. Thus, the endless intermediate transfer belt 7 having the superficial layer 7*a* was produced.

In this example, the superficial layer main body 7*d* of the intermediate transfer belt 7 has a volume resistivity of $10^{10}$ Ω·cm.

The content of the PTFE particles (superficial layer particles 73) in the cured resin film serving as the superficial layer 7*a* of the intermediate transfer belt 7 produced as described above was 50 parts by weight assuming that a solid volume of an acrylic resin in the cured resin film was 100 parts by weight. Similarly, the content of the sine antimonate particles (conductive agent 72) in the cured resin film of the produced intermediate transfer belt 7 was 25 parts by weight assuming that the solid volume of the acrylic resin in the cured resin film was 100 parts by weight.

All of the parts by weight of the superficial layer particles 73, the conductive agent 72, and the like described below are values with respect to 100 parts by weight of the solid volume of the acrylic resin in the cured resin film.

The projected area of the exposed portion of one superficial layer particle 73 and the method of controlling a particle projected area ratio are described. The projected area of the exposed portion of one superficial layer particle 73 can be controlled by a primary particle diameter of the superficial layer particle 73, and is preferably in a range of 10 nm to 5,000 nm, more preferably in a range of 100 nm to 500 nm. The particle projected area ratio can be controlled by the capacity of the superficial layer particle 73, and is preferably in a range of 10 parts by weight to 150 parts by weight, more preferably in a range of 30 parts by weight to 100 parts by weight. When the capacity of the superficial layer particles 73 is less than 10 parts by weight, the effect of enhancing secondary transfer efficiency obtained by improving a releasing property may not be obtained. Further, when the capacity of the superficial layer particles 73 is more than 150 parts by weight, it becomes difficult for the protrusion 83 to come into contact with the superficial layer main body 7*d* and image defects caused by charge-up may occur. The capacity of the conductive agent 72 is preferably in a range of 10 parts by weight to 40 parts by weight. When the capacity of she conductive agent 72 is less than 10 parts by weight, image defects caused by charge-up may occur. Further, when the capacity of the conductive agent 72 is more than 40 parts by weight, the electric resistance of the superficial layer decreases too much, and transfer defects may occur in a high-temperature and high-humidity environment.

Method of Measuring Projected Area of Superficial Layer Particle

Figure 7A:
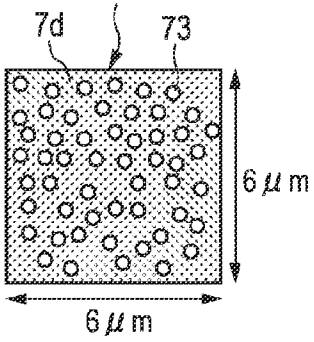
FIG. 7A is a schematic view illustrating observation results of a superficial layer of an intermediate transfer belt of Example 1.

In order to measure the projected area of an exposed portion of one superficial layer particle 73 in the superficial layer 7*a* of the produced intermediate transfer belt 7, a scanning probe microscope ("SPI3800" manufactured by SII Nano-Technology Inc.) was used. A cantilever made of silicone having a tip end radius of 15 nm or less, a spring constant or 15 N/m, and a resonance frequency of 135 KHz was used. A dynamic force mode was used as a measurement mode, with a measurement frequency being set to 0.3 to 1.0 Hz and an observation field being set to a 6 μm square region. The observation field is not limited thereto, and it is appropriate that the observation field is smaller than the contact region of the protrusion 83 of the secondary transfer roller 8 and is in a range in which the projected area of an exposed portion of one superficial layer particle 73 can be measured. FIG. 7A illustrates observation results.

The projected area of an expensed portion of one superficial, layer particle 73 can be measured by binarizing image data as illustrated in FIG. 7A obtained by the above-mentioned microscope observation by image processing and calculating an area of a portion (white circular portion in FIG. 7A) corresponding to the superficial layer particle 73. The particle projected area ratio is determined by calculating a ratio of the total of projected areas of exposed portions of the superficial layer particles 73 in a 6 μm square region with respect to a 6 μm square region (36 $\mu m^2$).

As illustrated in FIG. 7A, the projected area of an exposed portion of one spherical PTFE particle 73 was sufficiently smaller (about 0.031 $\mu m^2$) than the contact region of the protrusion 83, and the particle projected area ratio was 40%. Therefore, the protrusion 83 comes into contact with the superficial layer main body 7*d* reliably.

Evaluation Experiment

In order to check the presence/absence of occurrence of image defects caused by charge-up, the following evaluation experiment was conducted through use of the image forming apparatus 100 in thus embodiment.

Twenty sheets of a half-tone image with an image density of about 30 to 60% were formed continuously in a low-temperature and low-humidity environment at a temperature of 15° C. and a relative humidity of 10%, and the presence/absence of occurrence of image defects was checked. When image defects caused by charge-up of the superficial layer 7*a* of the intermediate transfer belt 7, such as scatter and a void, did not occur during continuous image formation, the evaluation was determined to be "good", and when the image defects occurred, the evaluation was determined to be "bad".

Table 1 shows evaluation results of this example. In this example, image defects caused by charge-up did not occur.

As a guideline, image defects caused by charge-up do not occur when the residual potential of the surface of the intermediate transfer belt 7 is 100 V or less in an environment at a temperature of 25° C. and a relative humidity of 50%. The residual potential is determined by charging the intermediate transfer belt 7 with a DC voltage of 1 kV superimposed on an AC voltage of 8 kV (Vpp) having a frequency of 500 Hz by a coroner charger and measuring the potential on the belt after charging for 0-5 seconds.

Example 2

In this example, the intermediate transfer belt 7 having the superficial layer 7*a* was obtained in the same way as in Example 1 except for adding 50 parts by weight of PTFE particles ("Lubron L-2" manufactured by Daikin Industries, Ltd.) having a primary particle diameter of 300 nm serving as the superficial layer particles 73 during preparation of the UV-curable resin composition.

Figure 7B:
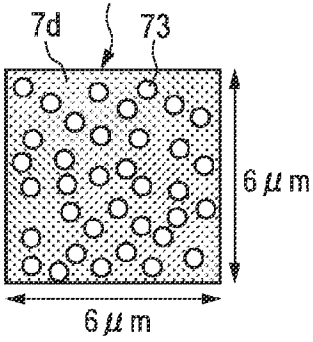
FIG. 7B is a schematic view illustrating observation results of a superficial layer of an intermediate transfer belt of Example 2.

It was found from observation using a scanning probe microscope similar to that in Example 1 that, although the projected area of an exposed portion of one PTFE particle 73 was larger than that of Example 1, the projected area was sufficiently smaller (about 0.071 $\mu m^2$) than the contact region of the protrusion 83, and the particle projected area ratio was 50%. Therefore, the protrusion 83 comes into contact with the superficial layer main body 7*d* reliably (FIG. 7B).

Table 1 shows evaluation results of the presence/absence of occurrence of image defects caused, by charge-up similar to those of Example 1. In Example 2, image defects caused by charge-up did not occur as in Example 1.

Example 3

In this example, the intermediate transfer belt 7 having the superficial layer 7*a* was obtained in the same way as in Example 1 except for adding 50 parts by weight of PTFE particles ("Lubron L-2" manufactured by Daikin Industries, Ltd.) having a primary particle diameter of 3,000 nm serving as the superficial layer particles 73 during preparation of she UV curable resin composition.

Figure 7C:
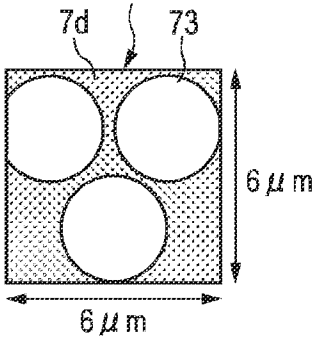
FIG. 7C is a schematic view illustrating observation results of a superficial layer of an intermediate transfer belt of Example 3.

It was found from observation using a scanning probe microscope similar to that in Example 1 that, although the projected area of an exposed portion of one PTFE particle 73 was larger than that of Example 2, the projected area was sufficiently smaller (about 7.060 $\mu m^2$) than the contact region of the protrusion 83, and the particle projected area ratio was 60%. Therefore, the protrusion 83 comes into contact with the superficial layer main body 7*d* reliably (FIG. 7C).

Table 1 shows evaluation results of the presence/absence of occurrence of image defects caused by charge-up similar to those of Example 1. In Example 3, image detects caused by charge-up did not occur as in Example 1.

Example 4

In this example, the intermediate transfer belt 7 having the superficial layer 7*a* was obtained in the same way as in Example 1 except for adding 50 party by weight of PTFE particles ("Lubron L-2" manufactured by Daikin Industries, Ltd.) with a primary particle diameter of 300 nm and 50 parts by weight of melamine silica resin particles ("Optobeads 1000" manufactured by Nissan Chemical Industries, Ltd.) having a primary particle diameter of 1,000 nm serving as the superficial layer particles 73 during preparation of the UV-curable resin composition.

Figure 7D:
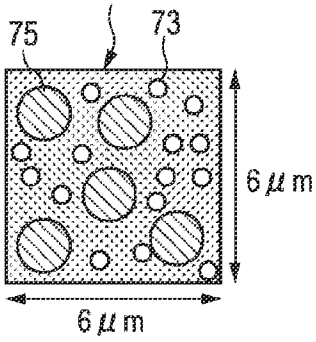
FIG. 7D is a schematic view illustrating observation results of a superficial layer of an intermediate transfer belt of Example 4.

It was confirmed from observation using a scanning probe microscope similar to that in Example 1 that the PTFE particles 73 having a small particle diameter and the melamine silica particles 75 having a large particle diameter were mixed and exposed, from the surface of the intermediate transfer belt 7. The projected area of an exposed portion of each of the PTFE particle 73 and the melamine silica particle 75 was sufficiently smaller (about 0.071 $\mu m^2$ for the PTFE particle, about 0.735 $\mu m^2$ for the melamine silica particle) than the contact region of the protrusion 83, and the particle projected area ratio was 50%. Therefore, the protrusion 33 comes into contact with the superficial layer main body 3*d* reliably (FIG. 7D).

Table 1 shows evaluation results of the presence/absence of occurrence of image defects caused by charge-up similar to those of Example 1. In Example 4, image defects caused by charge-up did not occur as in Example 1.

Example 5

In this example, the intermediate transfer belt 7 having the superficial layer 7*a* was obtained, in the same way as in Example 1 except for increasing the capacity of PTFE particles ("Lubron L-2" manufactured by Daikin Industries, Ltd.) having a primary particle diameter of 200 nm serving as the superficial layer particles 73 to 100 parts by weight during preparation of the UV-curable resin composition.

Figure 7E:
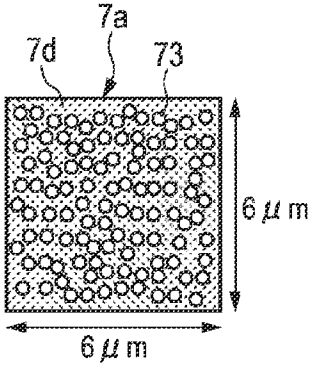
FIG. 7E is a schematic view illustrating observation results of a superficial layer of an intermediate transfer belt of Example 5.

It was found from observation using a scanning probe microscope similar to that in Example 1 that the projected area of an exposed portion of one PTFE particle 73 was sufficiently smaller (about 0.031 $\mu m^2$) than the contact region of the protrusion 33, and the particle projected; area ratio was 70%. Therefore, fine protrusion 33 comes into contact with the superficial layer main body 7*d* reliably (FIG. 7E).

Table 1 shows evaluation results of the presence/absence of occurrence of image defects caused by charge-up similar to those of Example 1. In Example 5, image defects caused by charge-up did not occur as in Example 1.

The results similar to those of Example 5 (and Examples 1 to 4) were obtained even when the capacity of the superficial layer particles 73 was increased further to increase the particle projected area ratio to 80% under the same condition as that of Example 5. On the other hand, when the capacity was decreased, the results similar to those of Example 5 (and Examples 1 to 4) were obtained regarding image defects caused by charge-up until the particle projected, area ratio reached 10%, but transfer efficiency was degraded when the particle projected, area ratio became less than 10%.

Comparative Example 1

In this comparative example, the intermediate transfer belt 7 saving the superficial layer 7*a* was obtained in the same way as in Example 1 except for drastically increasing the capacity of PTFE particles ("Lubron L-2" manufactured by Daikin Industries, Ltd.) having a primary particle diameter of 200 nm serving as she superficial layer particles 73 to 160 parts by weight during preparation of the UV-curable resin composition.

Figure 7F:
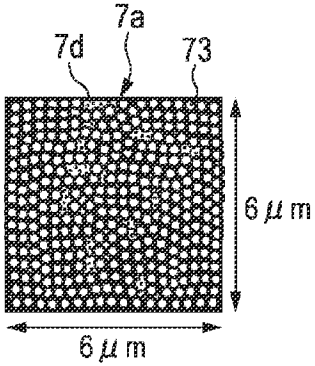
FIG. 7F is a schematic view illustrating observation results of a superficial layer of an intermediate transfer belt of Comparative Example 1.

It was found from observation using a scanning probe microscope similar to that in Example 1 that, although file projected area of an expensed portion of one PTFE particle 73 was sufficiently smaller (about 0.031 $\mu m^3$) than cue contact region of the protrusion 83, the particle projected area ratio was as large as 90%. Therefore, it was difficult for the protrusion 83 to come info contact with the superficial layer main body 7*d* reliably (FIG. 7F).

Table 1 shows evaluation results of the presence/absence of occurrence of image defects caused icy charge-up similar to those of Example 1. In Comparative Example 1, image defects caused, by charge-up occurred.

Comparative Example 2

In this comparative example, the intermediate transfer belt 7 having the superficial layer 7*a* was obtained in the same way as in Example 1 except that the conductive agent 72 was not added during preparation of the UV-curable resin composition.

In this comparative example, the volume resistivity of the superficial layer main body 7*d* of the intermediate transfer belt 7 was $10^{13}$ Ω·cm.

Figure 7G:
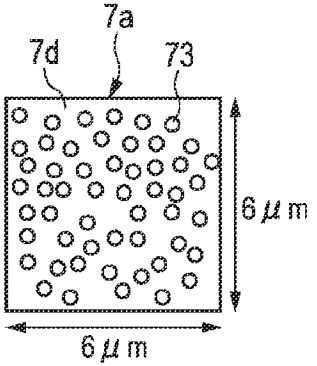
FIG. 7G is a schematic view illustrating observation results of a superficial layer of an intermediate transfer belt of Comparative Example 2.

It was found from observation using a scanning probe microscope similar to that in Example 1 that the projected area of an exposed portion of one PTFE particle 73 was sufficiently smaller than the contact region of the protrusion 83, and the particle projected area ratio was 40%. Therefore, the protrusion 83 comes into contact with the superficial layer main body 7*d* reliably (FIG. 7G).

However, when the presence/absence of occurrence of image defects caused by charge-up similar to that in Example 1 was checked, it was found that image defects caused by charge-up sometimes occurred. Table 1 shows evaluation results. It is considered that a conducting path was not likely to be formed and suppression of charge-up was thus difficult because, although the protrusion 83 came into contact with the superficial layer main body 7*d*, the superficial layer main body 7*a* had an insulation property without being adjusted for electric resistance in this comparative example.

Depending on the use condition each as a higher temperature and higher humidity environment, a certain effect can be obtained regarding particularly the suppression of charge-up of the superficial layer particles 73, by setting a relationship between the area of the contact region of the protrusion 83 and the projected area of the superficial layer particles 73 in accordance with the present invention and bringing the protrusion 83 info contact with the superficial layer main body 7*d*.

TABLE 1

| | Intermediate transfer belt base layer material Resin material | Intermediate transfer belt superficial layer material | | | | | | Charge-up image evaluation |
|---|---|---|---|---|---|---|---|---|
| | | Resin material | Resistance adjusting agent | Particle | | | | |
| | | | | Material | Primary particle diameter (nm) | Capacity (part by weight)* | Projected area ratio (%) | |
| Example 1 | Polyethylene naphthalate | Acrylic | Zinc antimonate | PTFE | 200 | 50 | 40 | Good |
| Example 2 | Polyethylene naphthalate | Acrylic | Zinc antimonate | PTFE | 300 | 50 | 50 | Good |
| Example 3 | Polyethylene naphthalate | Acrylic | Zinc antimonate | PTFE | 3,000 | 50 | 60 | Good |
| Example 4 | Polyethylene naphthalate | Acrylic | Zinc antimonate | PTFE<br>Melamine silica | 300<br>1,000 | 50<br>50 | 50 | Good |
| Example 5 | Polyethylene naphthalate | Acrylic | Zinc antimonate | PTFE | 200 | 100 | 70 | Good |
| Comparative Example 1 | Polyethylene naphthalate | Acrylic | Zinc antimonate | PTFE | 200 | 160 | 90 | Bad |
| Comparative Example 2 | Polyethylene naphthalate | Acrylic | — | PTFE | 200 | 50 | 40 | Bad |

*Part by weight assuming that solid volume of acrylic resin in cured film is 100 parts by weight The following was confirmed from the foregoing evaluation results. That is, the projected area of one superficial layer particle 73 exposed from the surface of the intermediate transfer belt 7 is smaller than the contact region of the protrusion 83 of the secondary transfer roller 8, and there needs to be a portion in which the superficial layer main body 7*d* and the protrusion 83 are held in contact with each other in the contact region of the protrusion 83. The superficial layer main body 7*d* of the intermediate transfer belt 7 is preferably adjusted for electric resistance to have appropriate conductivity, and the protrusion 83 preferably comes into contact with the superficial layer main body 7*d* as well as the insulating superficial layer particle 73, with the result that a portion, in which the protrusion 83 and the superficial layer main body 7*d* are held in contact with each other, serves as a conducting path. With such a configuration, image defects caused by charge-up can be prevented.

Thus, according to this embodiment, the image forming apparatus 100 includes the image bearing member 1 for bearing a toner and the movable intermediate transfer member 7 onto which a toner is transferred from the image bearing member 1. Further, the image forming apparatus 100 includes the secondary transfer member 8 including multiple protruding sections 83 which come into contact with the intermediate transfer belt 7. The secondary transfer member 8 and the intermediate transfer member 7 nip the transfer material S therebetween, and when a voltage is applied to the secondary transfer member 8, the secondary transfer member 8 transfers a toner on the intermediate transfer member onto the transfer material. The superficial layer 7*a* of the intermediate transfer member 7 includes the superficial layer main body 7*d* and the particles 73 buried in the superficial layer main body 7*d* so as to be partially exposed therefrom. In addition, the projected, area of an exposed portion of the particle 73 from the superficial layer main body 7*d* is smaller than the area of a contact region between the protrusion section 83 of the secondary transfer member 8 and the intermediate transfer member 7, and there exists a portion in which the protrusion section 83 and the superficial layer main body 7*d* are held in contact with each other in the contact region. The volume resistivity of the superficial layer main body 7*d* is preferably $10^9$ Ω·cm to $10^{12}$ Ω·cm. The projected area ratio of an exposed portion of the particle 73 on the surface of the intermediate transfer member 7 is preferably 10% to 80%. The secondary transfer member 8 has a foamed elastic layer made of a foamed elastic body including the protrusion sections 83, which come into contact with the intermediate transfer member 7, on the surface, and the secondary transfer member 8 is typically a roller-shaped member. According to this embodiment, in a configuration in which this particles 73 are exposed from the surface of the intermediate transfer member 7, image defects caused by charge-up of the intermediate transfer member 7 can be suppressed.

Another Embodiment

The present invention has been described by way of a specific embodiment, bun the present invention is not limited to the above-mentioned embodiment.

For example, in the foregoing embodiment, the intermediate transfer member is formed of two layers. However, a layer corresponding to the base layer of the above-mentioned embodiment may be formed of multiple layers, or a single layer or multiple layers may be provided on an underlying layer of the layer corresponding to the base layer in the above-mentioned embodiment.

The intermediate transfer member is not limited to a configuration including multiple layers. Even when the intermediate transfer member is a single layer, the effects similar to those of the above-mentioned embodiment can be obtained as long as the single layer has the configuration (relationship between superficial layer particles and protrusions, and electric resistance) similar to that of the superficial layer in the above-mentioned embodiment.

In the above-mentioned embodiment, as the cleaning device of the intermediate transfer member, a cleaning blade (blade cleaning system) is used. However, the present invention is not limited thereto. For example, the present invention can also be applied to an image forming apparatus (see Japanese Patent Application Laid-open No. 2009-205012, etc.) of an electrostatic cleaning system (transfer and simultaneous cleaning system), and the effects similar to those of the above-mentioned embodiment can be obtained. In the electrostatic cleaning system (transfer and simultaneous cleaning system), a toner on the intermediate transfer member is charged through use of a charging device such as a brush and a roller, and the toner is transferred onto a photosensitive member in a primary transfer section and collected.

The image forming apparatus is not limited to an in-line type. For example, the image forming apparatus may have the following system: multiple developing devices are provided with respect to one photosensitive member, and toner images formed successively on the photosensitive member are successively primarily-transferred onto an intermediate transfer member; and thereafter, the toner images overlapped with each other on the intermediate transfer member are secondarily-transferred onto a transfer material.

The intermediate transfer member is not limited to a belt shape. Even when the intermediate transfer member has a drum shape, for example, the present invention can be similarly applied to the drum-shaped intermediate transfer member to obtain the same effects.

The secondary transfer member is not limited to a roller-shaped member. As long as a secondary transfer member has protruding sections (protrusions, etc.) on the surface thereof, the present invention can be similarly applied so that secondary transfer member to obtain the same effects.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-280279, filed Dec. 21, 2012, which is hereby incorporated by reference herein in its entirety.

What is claimed is:

1. An image forming apparatus, comprising:

an image bearing member bearing a toner image;

an intermediate transfer member transferring the toner image on the image bearing member onto a transfer material, the intermediate transfer member being movable and including a superficial layer in which a plurality of insulating particles are buried so as to be partially exposed from the superficial layer; and a secondary transfer member nipping the transfer material between the secondary transfer member and the intermediate transfer member and transferring the toner image on the intermediate transfer member onto the transfer material when supplied with a voltage, the secondary transfer member including a plurality of protrusions which come into contact with the intermediate transfer member, wherein, in a case where the insulating particles are present in a contact region in which the protrusions are brought into contact with the intermediate transfer member, a portion in which the protrusions are brought into direct contact with the superficial layer is present in the contact region.

2. An image forming apparatus according to claim 1, wherein the intermediate transfer member is an intermediate transfer belt including the superficial layer, a base layer supporting the superficial layer, and the insulating particles dispersed in the superficial layer.

3. An image forming apparatus according to claim 2, wherein the secondary transfer member is a secondary transfer roller including a foamed elastic layer having the protrusions.

4. An image forming apparatus according to claim 3, wherein the superficial layer is formed of a curable resin.

5. An image forming apparatus according to claim 4, wherein the superficial layer is formed of an acrylic copolymer.

6. An image forming apparatus according to claim 5, wherein the superficial layer has electric resistance adjusted by a conductive agent.

7. An image forming apparatus according to claim 1, wherein a projected area of the insulating particles from the superficial layer is smaller than an area of the contact region between the protrusions and the intermediate transfer member.

8. An image forming apparatus according to claim 1, wherein the insulating particles comprise a solid lubricant.

9. An image forming apparatus according to claim 1, wherein the insulating particles comprise fluorine-containing particles.

10. An image forming apparatus according to claim 1, wherein the insulating particles comprise polytetrafluoroethylene.

11. An image forming apparatus, according to claim 6, wherein the conductive agent is dispersed in a content of 10 parts by weight to 40 parts by weight with respect to 100 parts by weight of a solid volume of the superficial layer.

12. An image forming apparatus according to claim 1, wherein the superficial layer has a volume resistivity of $10^9$ Ω·cm to $10^{12}$ Ω·cm.

13. An image forming apparatus according to claim 1, wherein the insulating particles are dispersed in a content of 10 parts by weight to 150 parts by weight with respect to 100 parts by weight of a solid volume of the superficial layer.

14. An image forming apparatus according to claim 1, wherein a projected area ratio obtained by dividing a total of projected areas of the insulating particles exposed from the superficial layer in a predetermined area by the predetermined area is 10% to 80%.

15. An image forming apparatus according to claim 14, wherein the projected area ratio is 40% to 70%.

16. An image forming apparatus according to claim 1, wherein the secondary transfer member is brought into contact with the intermediate transfer member while being supplied with a voltage during image formation.

* * * * *